US011022914B2

(12) United States Patent
Okabe

(10) Patent No.: US 11,022,914 B2
(45) Date of Patent: Jun. 1, 2021

(54) IMAGE FORMING APPARATUS

(71) Applicant: FUJI XEROX CO., LTD., Tokyo (JP)

(72) Inventor: Masafumi Okabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/822,629

(22) Filed: Mar. 18, 2020

(65) Prior Publication Data

US 2021/0080872 A1 Mar. 18, 2021

(30) Foreign Application Priority Data

Sep. 18, 2019 (JP) ..... JP2019-168960

(51) Int. Cl.
*G03G 15/16* (2006.01)
*G03G 21/20* (2006.01)

(52) U.S. Cl.
CPC ..... *G03G 15/161* (2013.01); *G03G 21/203* (2013.01); *G03G 21/206* (2013.01)

(58) Field of Classification Search
CPC .... G03G 15/161; G03G 21/20; G03G 21/203; G03G 21/206
See application file for complete search history.

(56) References Cited

U.S. PATENT DOCUMENTS

| | | | | |
|---|---|---|---|---|
| 9,342,048 | B2 | 5/2016 | Sasaki | |
| 2017/0139352 | A1* | 5/2017 | Sawada | G03G 15/161 |
| 2018/0039199 | A1* | 2/2018 | Ai | G03G 21/0094 |
| 2018/0089545 | A1* | 3/2018 | Ikeda | G03G 15/607 |

FOREIGN PATENT DOCUMENTS

| | | | |
|---|---|---|---|
| JP | 2007-304136 | A | 11/2007 |
| JP | 2012-103307 | A | 5/2012 |
| JP | 2015-225282 | A | 12/2015 |

OTHER PUBLICATIONS

Machine Translation of JP 2012-103307. May 31, 2012. (Year: 2012).*

* cited by examiner

*Primary Examiner* — Carla J Therrien
(74) *Attorney, Agent, or Firm* — Sughrue Mion, PLLC

(57) ABSTRACT

An image forming apparatus including a revolving member, a first-transfer member, a second-transfer member that transfers the toner image on the revolving member onto a recording medium, a removing member downstream of the second-transfer member to remove a deposit on the revolving member, a fixing device that generates heat and that fixes the toner image transferred on the recording medium, a generating member that causes air to flow from the fixing device toward the revolving member, and an executing unit that executes a removal mode including causing the fixing device to generate heat, causing the generating member to operate, causing the revolving member to operate, causing the first-transfer member to operate so as to transfer a cleaning image as a toner image onto the revolving member, and causing the removing member to remove the cleaning image from the revolving member without transferring the cleaning image onto the recording medium.

13 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2019-168960 filed Sep. 18, 2019.

BACKGROUND

(i) Technical Field

The present disclosure relates to image forming apparatuses.

(ii) Related Art

An image forming apparatus disclosed in Japanese Unexamined Patent Application Publication No. 2015-225282 includes an image reader, an image processor, a sheet size detector, a photoconductor drum, a photoconductor driver, a charging device, an exposure device, a developing device, a transfer device, a cleaning device, a cleaning driver, an air blower, a temperature-and-humidity detector, a controller, a charger remover, a fixing device, a sheet feeder, and a transport unit.

SUMMARY

An image forming apparatus includes a revolving member (i.e., a transfer belt) that receives a toner image transferred from a photoconductor while revolving, and that transfers this toner image onto a recording medium. When the revolving member transfers the toner image onto the recording medium, a deposit, such as a discharge product, adheres to the revolving member. When a certain time elapses after the image forming operation is completed, the deposit may increase in adhesive force against the revolving member. Moreover, when the deposit absorbs moisture, it may be difficult to remove the deposit from the revolving member only with a removing member, such as a blade, used for removing the deposit from the revolving member.

Aspects of non-limiting embodiments of the present disclosure relate to reducing the deposit remaining on the revolving member, as compared with a case where the deposit is removed from the revolving member by using the removing member alone.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a revolving member that revolves, a first-transfer member that transfers a toner image onto the revolving member, a second-transfer member that transfers the toner image on the revolving member onto a recording medium, a removing member that is disposed downstream of the second-transfer member and upstream of the first-transfer member in a revolving direction of the revolving member and that removes a deposit adhered on the revolving member, a fixing device that generates heat and that fixes the toner image transferred on the recording medium by the second-transfer member onto the recording medium, a generating member that causes air to flow from the fixing device toward the revolving member, and an executing unit that executes a removal mode including causing the fixing device to generate heat, causing the generating member to operate, causing the revolving member to operate, causing the first-transfer member to operate so as to transfer a cleaning image as a toner image onto the revolving member, and causing the removing member to remove the cleaning image from the revolving member without causing the second-transfer member to transfer the cleaning image onto the recording medium.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
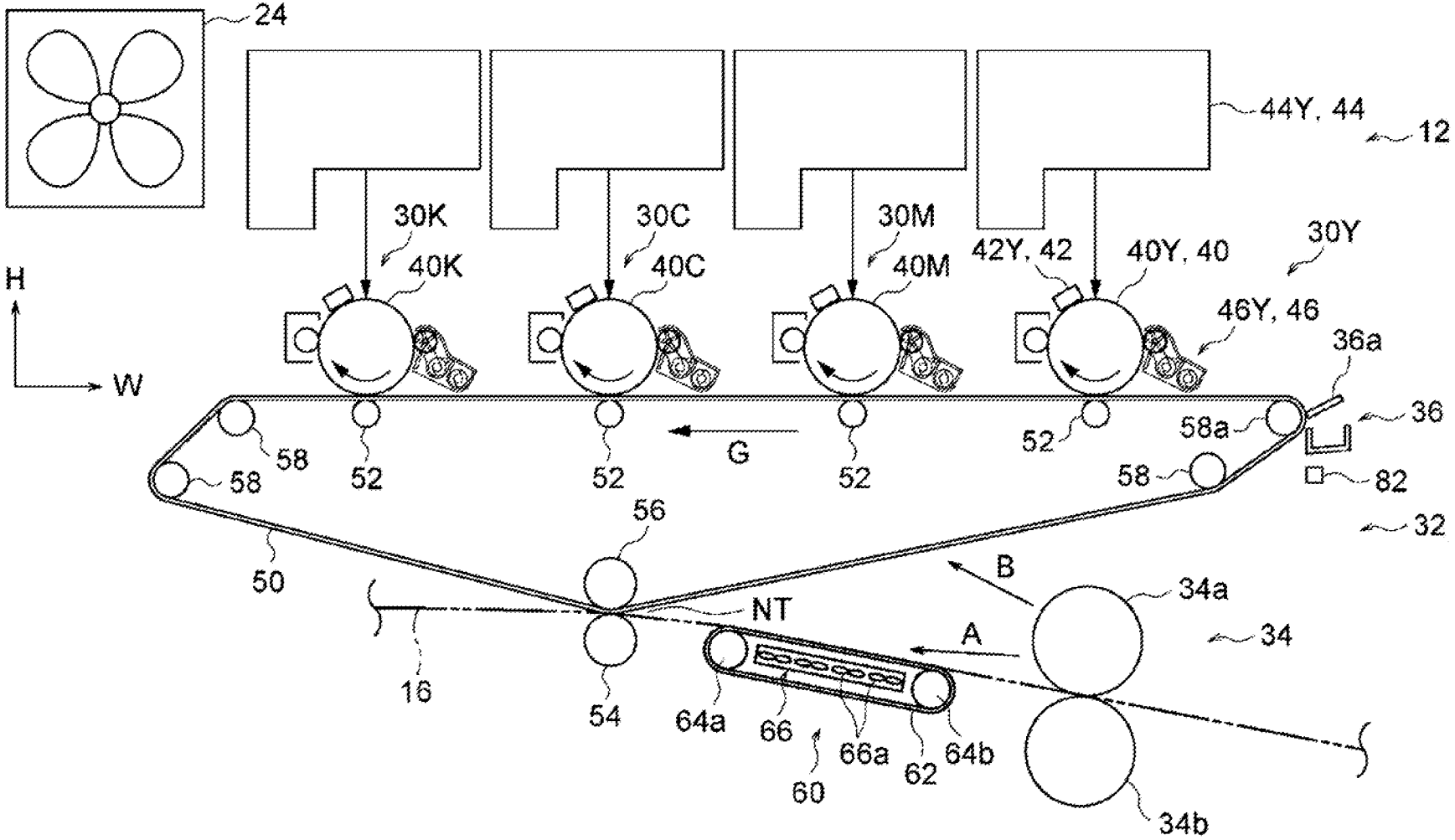
FIG. 1 is a configuration diagram illustrating relevant components of an image forming apparatus according to a first exemplary embodiment of the present disclosure.

An example of an image forming apparatus according to a first exemplary embodiment of the present disclosure will now be described with reference to FIGS. 1 to 11. In the drawings, an arrow H indicates an up-down direction as a vertical direction of the apparatus, an arrow W indicates a width direction as a horizontal direction of the apparatus, and an arrow D indicates a depth direction as another horizontal direction of the apparatus.

Overall Configuration of Image Forming Apparatus

Figure 11:
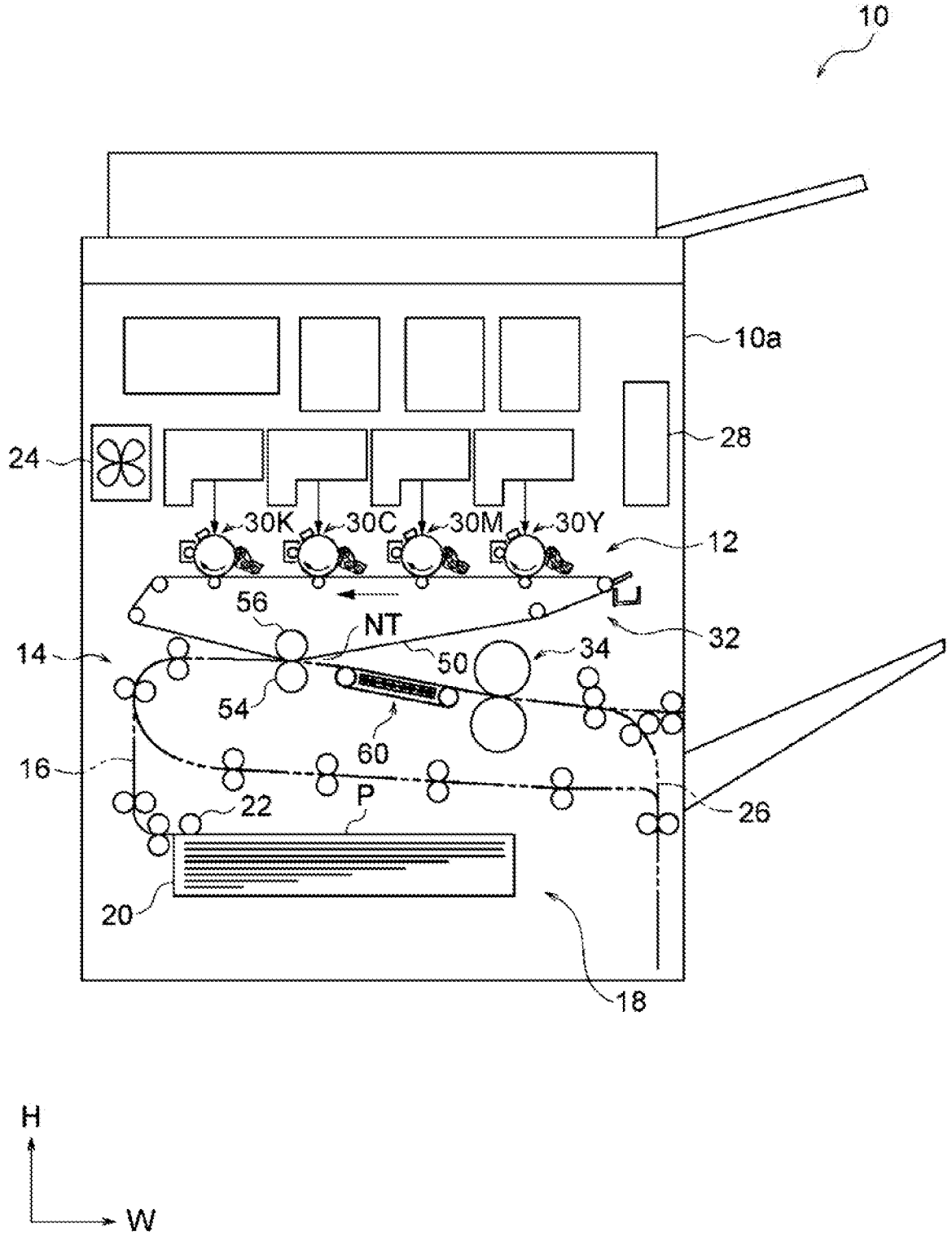
FIG. 11 schematically illustrates the configuration of the image forming apparatus according to the first exemplary embodiment of the present disclosure.

As shown in FIG. 11, an image forming apparatus 10 includes an image forming unit 12 that forms a toner image by electrophotography, a container 18 that contains recording media P, a controller 28 that controls each component, and an exhaust unit 24. Moreover, the image forming apparatus 10 includes a transport unit 14 that transports each recording medium P contained in the container 18 along a transport path 16. The transport unit 14 also inverts the front and rear faces of the recording medium P transported along the transport path 16 by transporting the recording medium P along an inversion path 26, and transports the recording medium P to the image forming unit 12 again.

In the image forming apparatus 10 having this configuration, the toner image formed by the image forming unit 12 is formed onto the front face of the recording medium P transported along the transport path 16. Furthermore, the recording medium P having the toner image formed thereon is output outside an apparatus body 10*a*.

In a case where an image is to be formed on the rear face of the recording medium P, the recording medium P having the image formed on the front face thereof is transported along the inversion path 26 so that an image is formed on the rear face of the recording medium P at the image forming unit 12 again, and is output outside the apparatus body 10*a*.

Image Forming Unit 12

As shown in FIG. 11, the image forming unit 12 includes multiple toner-image forming units 30 that individually form toner images of respective colors, and also includes a transfer unit 32 that transfers the toner images formed at the toner-image forming units 30 onto the recording medium P. Furthermore, the image forming unit 12 includes a fixing device 34 that fixes the toner images transferred on the recording medium P by the transfer unit 32 onto the recording medium P.

Toner-Image Forming Units 30

As shown in FIG. 1, the multiple toner-image forming units 30 are provided to form toner images of respective colors. In this exemplary embodiment, there are four toner-image forming units 30 provided for yellow (Y), magenta (M), cyan (C), and black (K) colors. In the following description, if the yellow (Y), magenta (M), cyan (C), and black (K) colors are not to be distinguished from one another, Y, M, C, and K added to the reference signs will be omitted.

Figure 10:
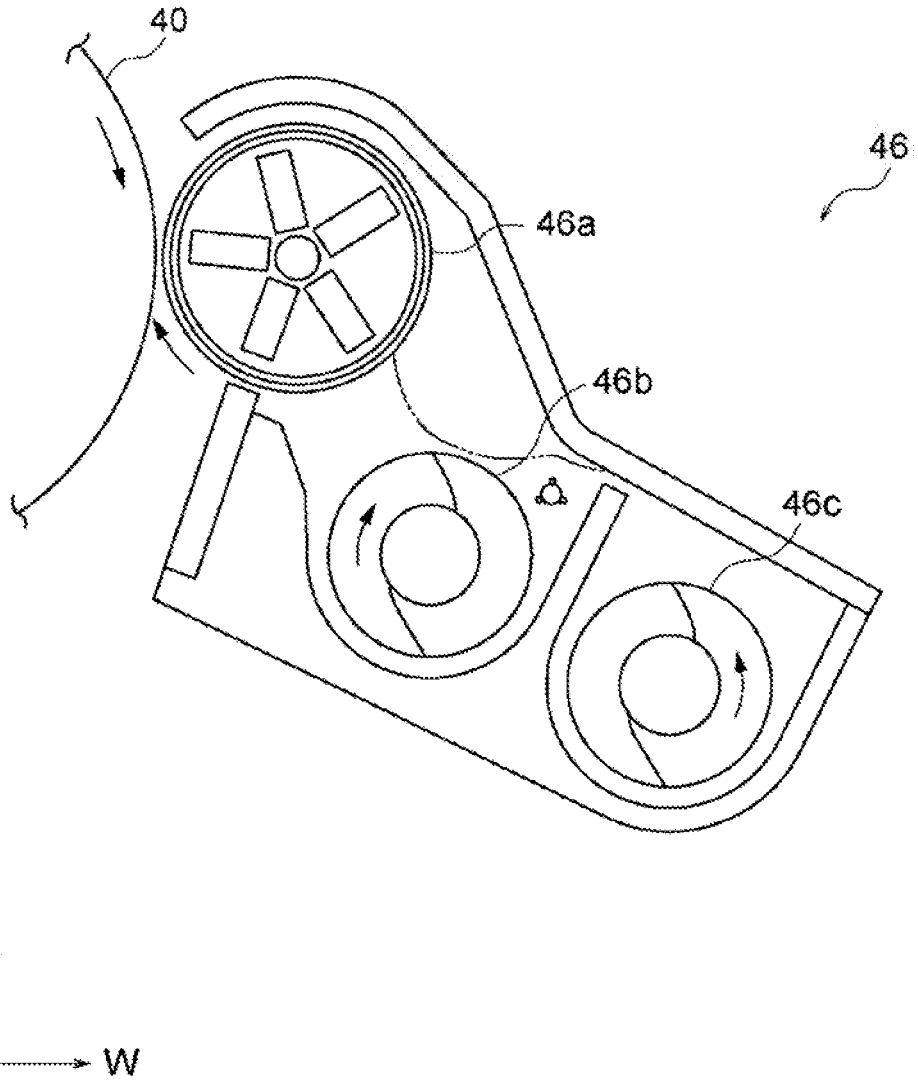
FIG. 10 is a cross-sectional view illustrating a developing device of the image forming apparatus according to the first exemplary embodiment of the present disclosure.

The toner-image forming units 30 for the respective colors basically have identical configurations except for the toners used, and each include a rotating cylindrical image bearing member 40 and a charger 42 that electrostatically charges the image bearing member 40. Furthermore, each toner-image forming unit 30 includes an exposure device 44 that forms an electrostatic latent image by radiating exposure light onto the electrostatically-charged image bearing member 40, and also includes a developing device 46 that develops the electrostatic latent image into a toner image by using a developer G that contains a toner. As shown in FIG. 10, the developing device 46 includes a developing roller 46*a* that faces the image bearing member 40, a feeding auger 46*b* that feeds the developer G to the developing roller 46*a*, and a stirring auger 46*c* that stirs the developer G.

In this configuration, the toner-image forming unit 30 for each color forms an image of that color by using a toner of that color.

As shown in FIG. 1, the image bearing members 40 for the respective colors are in contact with a revolving transfer belt 50 (to be described in detail later). The toner-image forming units 30 for the yellow (Y), magenta (M), cyan (C), and black (K) colors are arranged in the horizontal direction in this order from upstream in the revolving direction (see an arrow in FIG. 1) of the transfer belt 50.

Transfer Unit 32

As shown in FIG. 1, the transfer unit 32 includes multiple rollers 58, a loop roller 56, the transfer belt 50 that is wrapped around the multiple rollers 58 and the loop roller 56 and that revolves in the direction of the arrow in FIG. 1, first-transfer rollers 52, a removing member 36, and a second-transfer roller 54. A second-transfer section NT that transfers the toner images onto the recording medium P is formed between the second-transfer roller 54 and the transfer belt 50. The configuration of the transfer unit 32 will be described in detail later.

Fixing Device 34

As shown in FIG. 1, the fixing device 34 is disposed downstream of the second-transfer section NT in the transport direction of the recording medium P. The fixing device 34 will be described in detail later.

Container 18

As shown in FIG. 11, the container 18 includes an accommodation member 20 capable of accommodating recording media P and a feed roller 22 that feeds the uppermost one of the recording media P stacked on the accommodation member 20 to the transport path 16.

Transport Unit 14

As shown in FIG. 11, the transport unit 14 includes multiple transport rollers (not given reference signs) that transport the recording medium P fed from the container 18 along the transport path 16, and also includes a belt unit 60 that transports the recording medium P having a toner image transferred thereon and delivers the recording medium P to the fixing device 34. The belt unit 60 will be described in detail later.

Furthermore, the transport unit 14 includes multiple transport rollers (not given reference signs) that transport the recording medium P along the inversion path 26 to which the recording medium P passing through the fixing device 34 is delivered in a case where an image is to be formed on the rear face of the recording medium P. In the inversion path 26, the transport direction of the recording medium P is reversed (i.e., switched back) so that the front and rear faces thereof are inverted.

In this configuration, when a toner image is to be formed on the front face of the recording medium P, the transport unit 14 transports the recording medium P fed from the container 18 along the transport path 16. Then, the second-transfer section NT transfers the toner image onto the front face of the recording medium P, and the fixing device 34 fixes the toner image onto the recording medium P.

If a toner image is to be formed also on the rear face of the recording medium P, the transport unit 14 inverts the front and rear faces of the recording medium P by transporting the recording medium P passing through the fixing device 34 along the inversion path 26. Furthermore, the transport unit 14 causes the recording medium P, whose front and rear faces have been inverted, to merge into the transport path 16, and transports the recording medium P along the transport path 16. Then, the second-transfer section NT transfers the toner image onto the rear face of the recording medium P, and the fixing device 34 fixes the toner image onto the recording medium P.

Exhaust Unit 24

As shown in FIG. 11, the exhaust unit 24 is attached to the apparatus body 10*a* such that the air inside the apparatus body 10*a* is discharged outside the apparatus body 10*a*. The exhaust unit 24 will be described in detail later.

Controller 28

Figure 8:
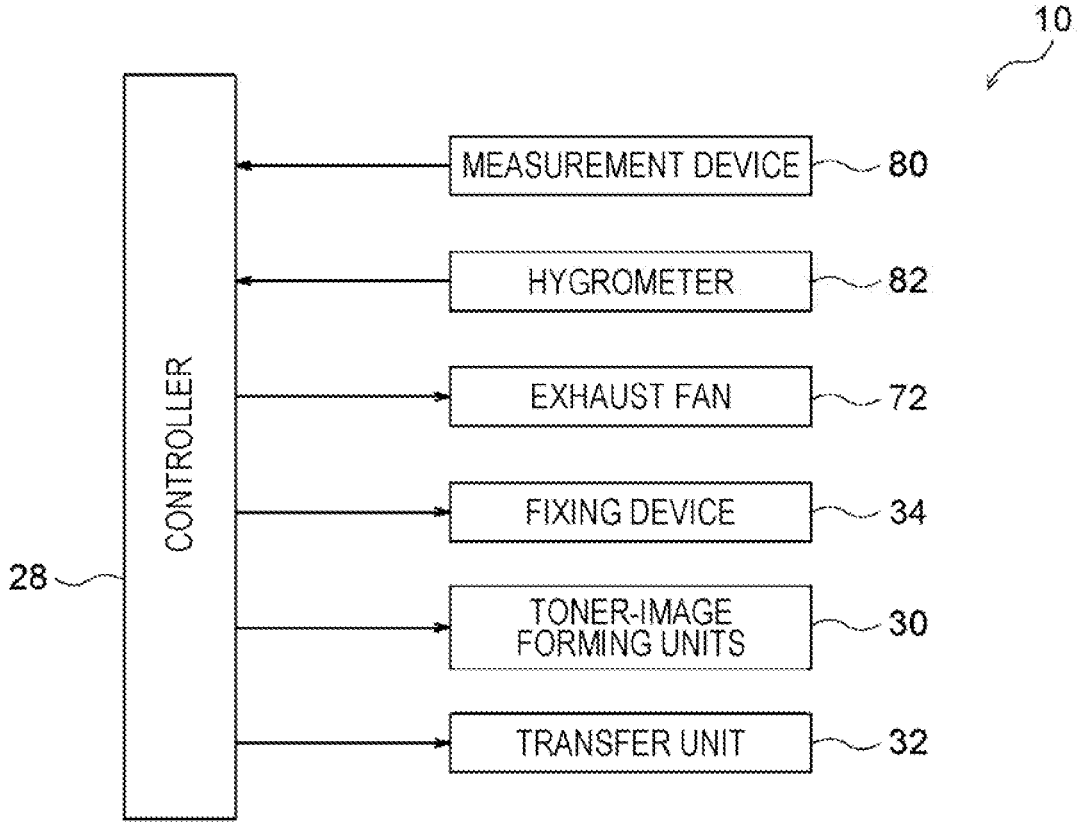
FIG. 8 is a block diagram illustrating a control system of a controller included in the image forming apparatus according to the first exemplary embodiment of the present disclosure.

As shown in FIG. 8, the controller 28 controls each component. The control of each component by the controller 28 will be described later together with the operation.

Operation of Overall Configuration

In the image forming apparatus 10, an image is formed as follows.

First, the charger 42 for each color shown in FIG. 1 negatively charges the surface of the image bearing member 40 for that color uniformly with a predetermined potential. Then, the exposure device 44 forms an electrostatic latent image on the electrostatically-charged surface of the image bearing member 40 by radiating exposure light thereto. Consequently, the electrostatic latent image is formed on the surface of the image bearing member 40. Furthermore, the developing device 46 for that color develops this electrostatic latent image into a visual image as a toner image. The toner images formed on the surfaces of the image bearing members 40 for the respective colors are sequentially transferred onto the transfer belt 50 by the first-transfer rollers 52.

The recording medium P fed from the accommodation member 20 shown in FIG. 11 to the transport path 16 by the feed roller 22 is fed to the second-transfer section NT where the transfer belt 50 and the second-transfer roller 54 are in contact with each other. At the second-transfer section NT, the recording medium P is transported between the transfer belt 50 and the second-transfer roller 54, so that the toner images on the transfer belt 50 are transferred onto the surface of the recording medium P.

The toner images transferred on the surface of the recording medium P are fixed onto the recording medium P by the fixing device 34. Then, the recording medium P having the toner images fixed thereon is output outside the apparatus body 10*a*.

In a case where toner images are to be formed also on the rear face of the recording medium P, the recording medium P having the toner images formed on the front face thereof is transported along the inversion path 26 so that the front and rear faces are inverted, and is transported again to the second-transfer section NT. Then, toner images formed as a result of undergoing a process similar to the above-described process are transferred onto the rear face of the recording medium P. The toner images transferred on the rear face of the recording medium P are fixed onto the recording medium P by the fixing device 34. Furthermore, the recording medium P having the toner images fixed thereon is output outside the apparatus body 10*a*.

Configuration of Relevant Components

Next, the transfer unit 32, the fixing device 34, the belt unit 60 of the transport unit 14, the exhaust unit 24, and the controller 28 will be described.

Transfer Unit 32

Figure 4:
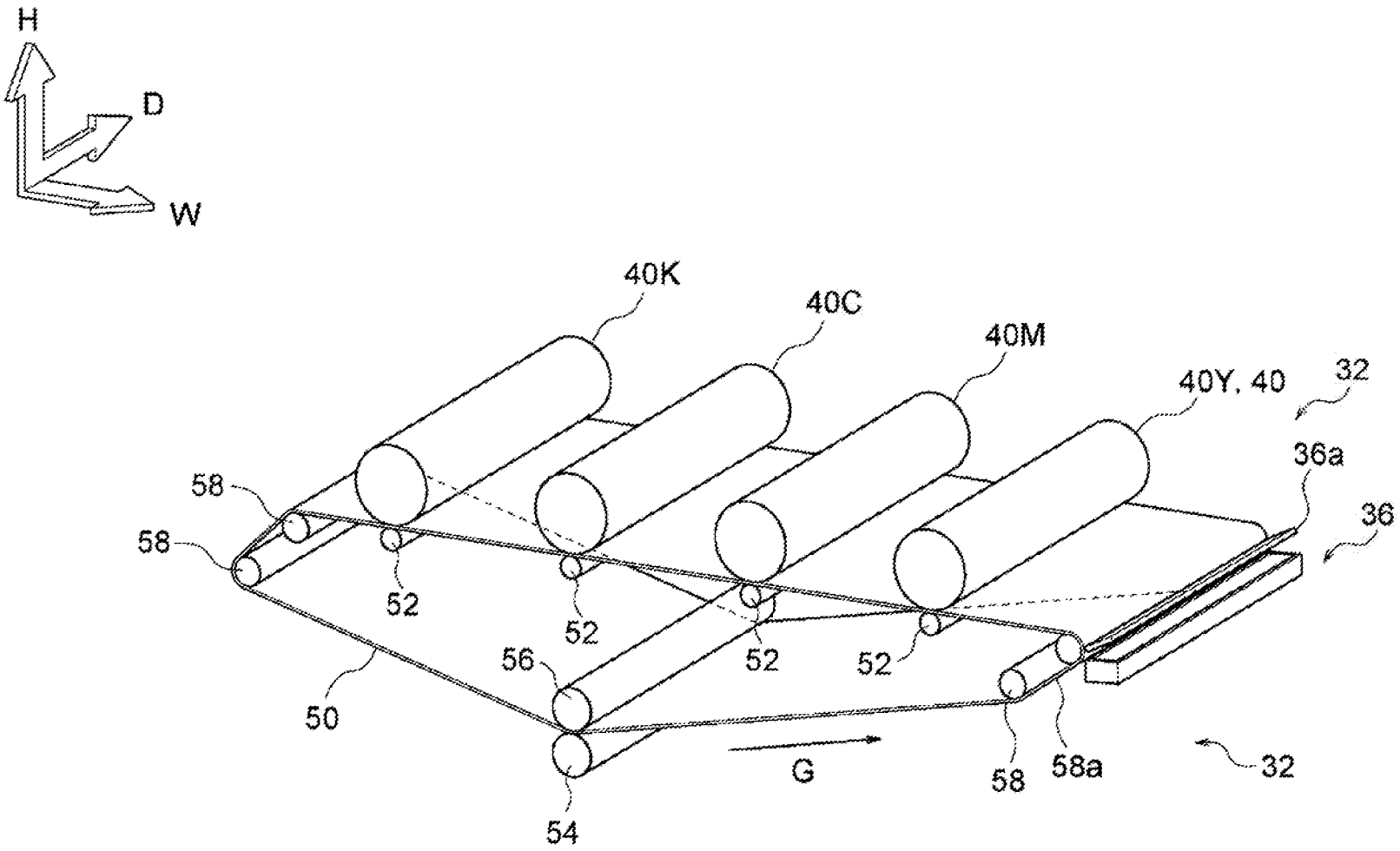
FIG. 4 is a perspective view illustrating the transfer unit and other components of the image forming apparatus according to the first exemplary embodiment of the present disclosure.

As shown in FIGS. 1 and 4, the transfer unit 32 includes the multiple rollers 58, the loop roller 56, and the transfer belt 50 that is wrapped around the multiple rollers 58 and the loop roller 56 and that revolves in the direction of an arrow G. In a state where the transfer belt 50 is wrapped around the multiple rollers 58 and the loop roller 56, the transfer belt 50 has a substantially triangular shape with a downward pointing apex, as viewed from the depth direction of the apparatus. The transfer belt 50 is an example of a revolving member.

Furthermore, the transfer unit 32 includes the first-transfer rollers 52 that transfer the toner images formed on the image bearing members 40 for the respective colors onto the transfer belt 50 in accordance with a transfer current. Moreover, the transfer unit 32 includes the second-transfer roller 54 that transfers the toner images on the transfer belt 50 onto the recording medium P in accordance with a transfer current, and the removing member 36 that removes a deposit, such as a discharge product, adhered on the transfer belt 50 from the transfer belt 50. Each first-transfer roller 52 is an example of a first-transfer member, and the second-transfer roller 54 is an example of a second-transfer member.

The apex of the transfer belt 50 is looped over the loop roller 56, and one side (i.e., the right side in the drawings) of the transfer belt 50 in the width direction of the apparatus is looped over a roller 58*a* included in the rollers 58. One of the multiple rollers 58 is rotationally driven so that the transfer belt 50 rotates in the direction of the arrow G (i.e., in the counterclockwise direction). The image bearing members 40 for the respective colors are in contact with a part of the transfer belt 50 where the peripheral surface thereof faces upward. The image bearing members 40 (i.e., the toner-image forming units 30) for the yellow (Y), magenta (M), cyan (C), and black (K) colors are arranged in this order from upstream in the revolving direction of the transfer belt 50.

The first-transfer rollers 52 are disposed opposite the image bearing members 40 of the respective colors with the transfer belt 50 interposed therebetween. Furthermore, the second-transfer roller 54 is disposed opposite the loop roller 56 with the transfer belt 50 interposed therebetween, and the second-transfer section NT that transfers a toner image onto a recording medium P is formed between the second-transfer roller 54 and the transfer belt 50.

Figure 2:
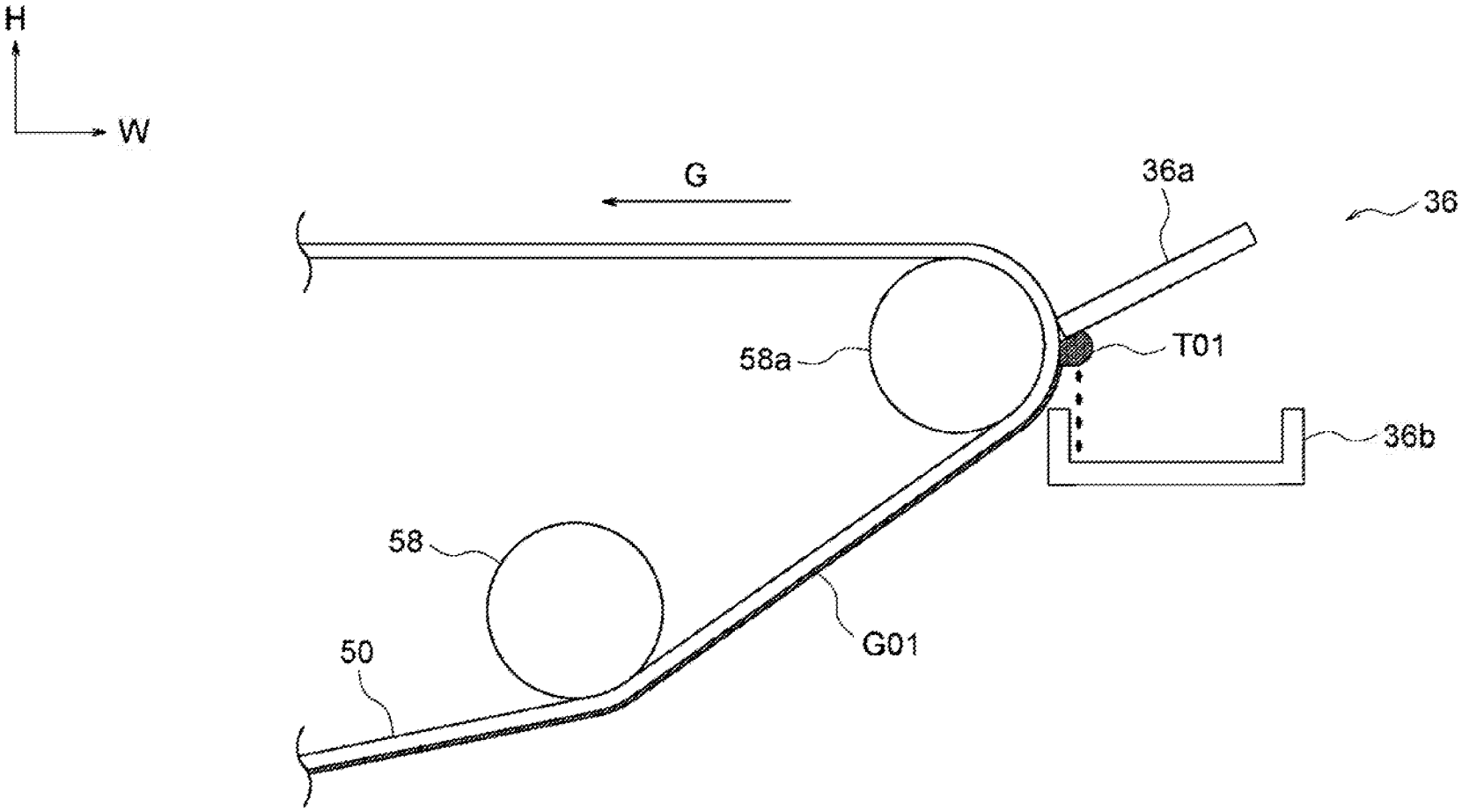
FIG. 2 is a configuration diagram illustrating a removing member and other components included in a transfer unit of the image forming apparatus according to the first exemplary embodiment of the present disclosure.

The removing member 36 is disposed downstream of the second-transfer section NT and upstream of the first-transfer rollers 52 in the revolving direction (referred to as "belt revolving direction" hereinafter) of the transfer belt 50, as well as opposite the roller 58*a* with the transfer belt 50 interposed therebetween. As shown in FIG. 2, the removing member 36 includes a scraping blade 36*a* whose edge comes into contact with the peripheral surface of the transfer belt 50 to scrape off a deposit adhered to the transfer belt 50, and also includes a collection box 36*b* that collects the deposit scraped off by the scraping blade 36*a*.

In this configuration, the removing member 36 removes the deposit adhered to the transfer belt 50. In other words, the removing member 36 suppresses a partial change in the electrical performance of the transfer belt 50. Specifically, the removing member 36 functions as a performance maintaining unit that maintains the electrical performance of the transfer belt 50.

Fixing Device 34

As shown in FIG. 1, the fixing device 34 is disposed below the transfer belt 50 and downstream of the second-transfer section NT in the transport direction (referred to as "medium transport direction" hereinafter) of the recording medium P. Accordingly, as viewed in the width direction of the apparatus, the fixing device 34 is disposed within a range in which the transfer belt 50 is disposed.

The fixing device 34 includes a heating roller 34*a* that contains a heat source therein and that is rotated by a driver, and also includes a pressing roller 34*b* that is disposed facing the heating roller 34*a* and that presses the recording medium P having a toner image transferred thereon toward the heating roller 34*a*.

In this configuration, if the toner image transferred on the recording medium P is to be fixed onto the recording medium P, the peripheral surface of the heating roller 34*a* is increased in temperature to, for example, about 180° C. Then, the rotating heating roller 34*a* and the pressing roller 34*b* rotated by being driven by the heating roller 34*a* nip and transport the recording medium P, so that the fixing device 34 fixes the toner image onto the recording medium P.

Belt Unit 60

As shown in FIG. 1, the belt unit 60 is disposed downstream of the second-transfer section NT and upstream of the fixing device 34 in the medium transport direction.

Figure 5:
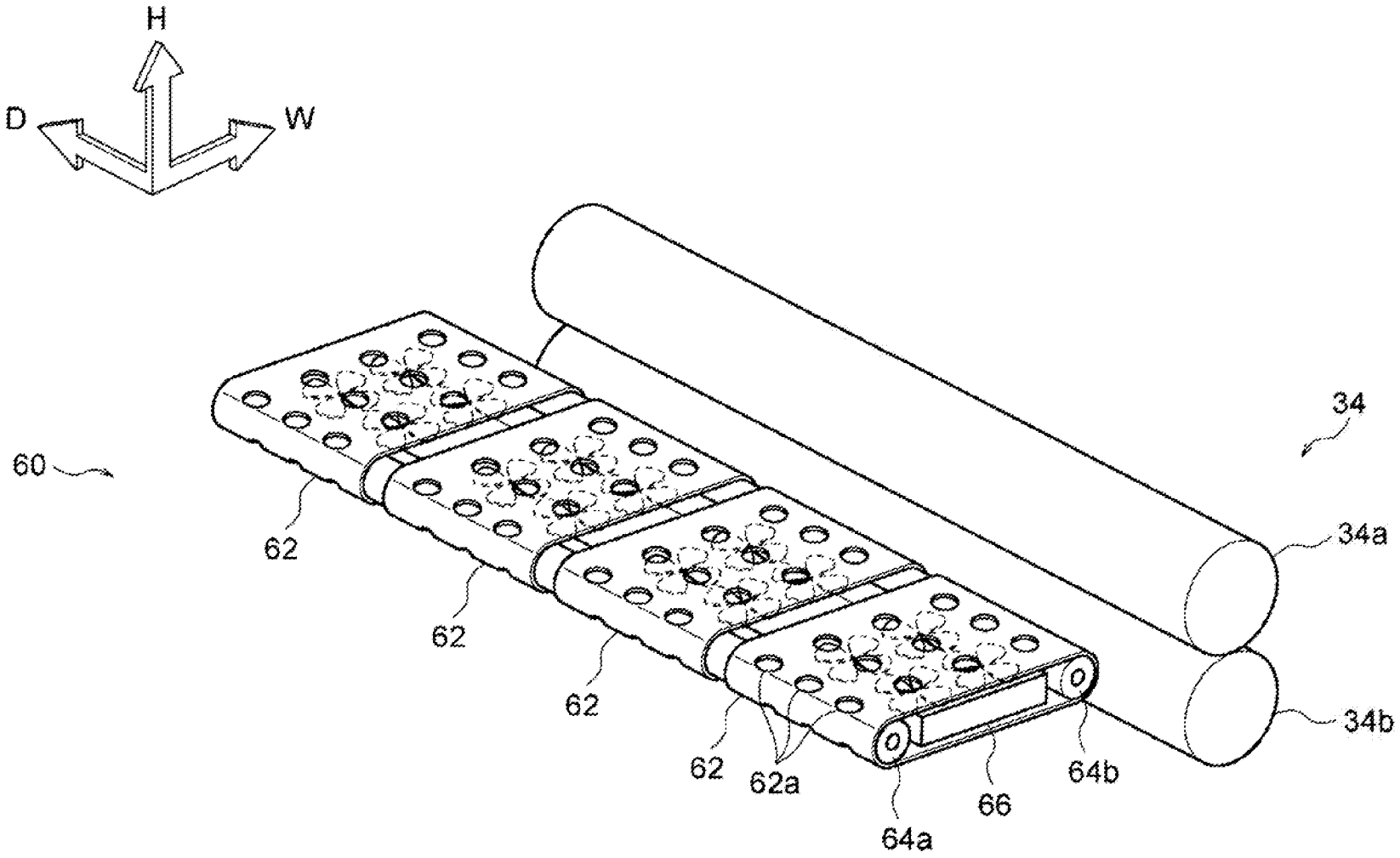
FIG. 5 is a perspective view illustrating a belt unit and a fixing device of the image forming apparatus according to the first exemplary embodiment of the present disclosure.

As shown in FIGS. 1 and 5, the belt unit 60 includes endless transport belts 62, a driving roller 64*a* and a driven roller 64*b* around which the transport belts 62 are wrapped, and a suction unit 66 that takes in the air above the transport belts 62 by suction.

The multiple transport belts 62 are arranged in the depth direction of the apparatus, and each transport belt 62 has multiple through holes 62*a*. The suction unit 66 has a suction fan 66*a* disposed therein. When the suction fan 66*a* is in operation, the suction unit 66 takes in the air above the transport belts 62 by suction so that the recording medium P attaches to the transport belts 62 by suction.

In this configuration, the rotationally-driven driving roller 64*a* transmits a rotational force to the transport belts 62, thereby causing the transport belts 62 to revolve. Furthermore, the suction unit 66 takes in the air above the transport belts 62 by suction so that the belt unit 60 transports the recording medium P while attaching the recording medium P to the transport belts 62 by suction. When the suction fan 66*a* operates in a state where the recording medium P is not being transported, the air around the heating roller 34*a* flows toward the belt unit 60, as indicated by an arrow A shown in FIG. 1. In other words, the suction fan 66*a* in operation causes the air around the heating roller 34*a* to flow toward the transfer belt 50.

Exhaust Unit 24

Figure 3:
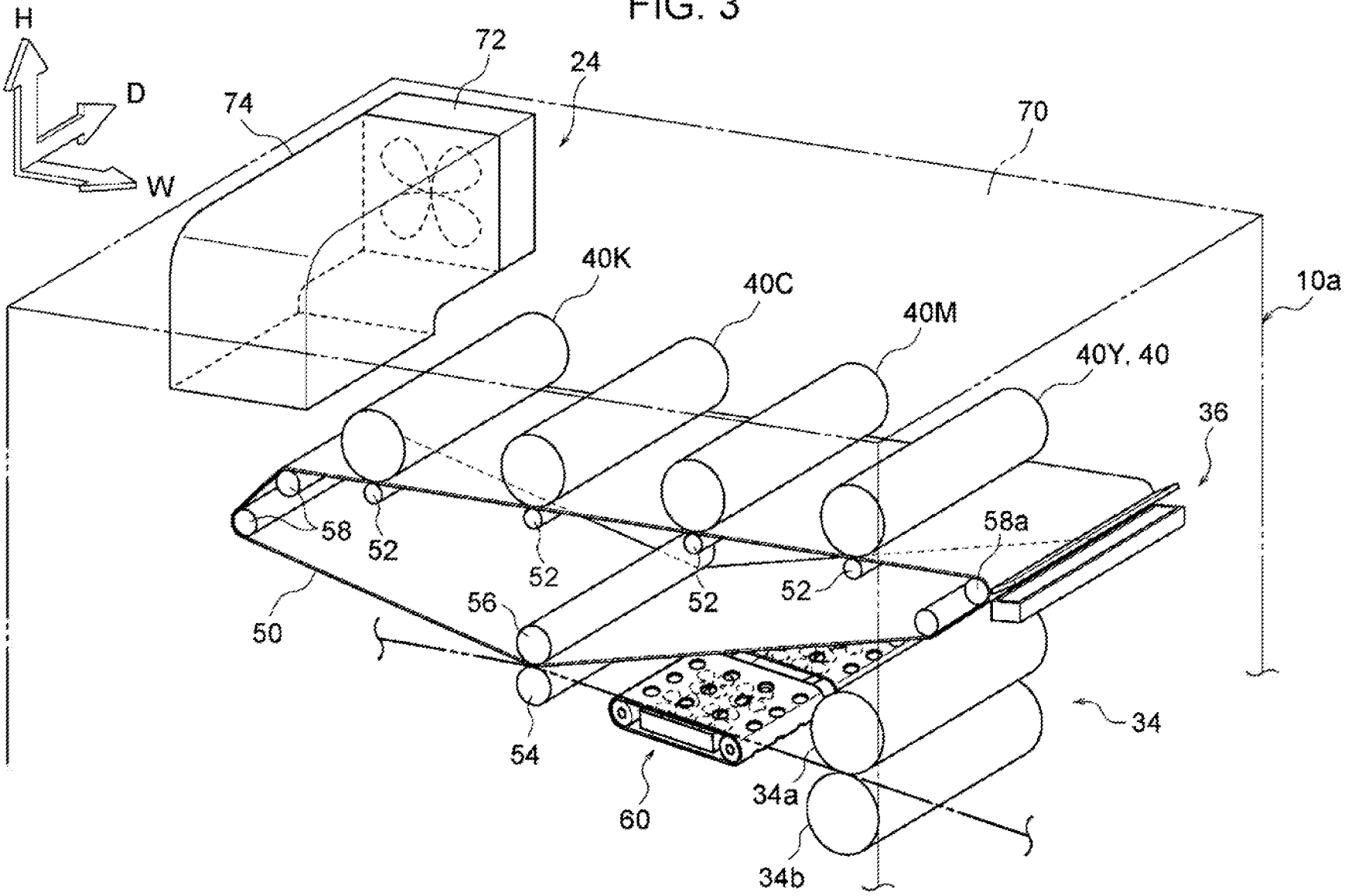
FIG. 3 is a perspective view illustrating an image forming unit and the transfer unit of the image forming apparatus according to the first exemplary embodiment of the present disclosure.

The exhaust unit 24 is disposed opposite the fixing device 34 with the transfer belt 50 interposed therebetween, as viewed from the depth direction of the apparatus, as shown in FIG. 1, and is attached to a rear plate 70 of the apparatus body 10*a*, as shown in FIG. 3. The exhaust unit 24 is an example of a generating member.

The exhaust unit 24 includes an exhaust fan 72 and an exhaust duct 74. The base end of the exhaust duct 74 is connected to the exhaust fan 72, and the distal end of the exhaust duct 74 is open toward the peripheral surface of the transfer belt 50.

In this configuration, when the exhaust fan 72 is in operation, the exhaust unit 24 takes in the air at the peripheral surface of the transfer belt 50 and causes the air to pass through a filter (not shown). Then, the exhaust unit 24 discharges the air outside the apparatus body 10*a*.

When the exhaust fan 72 is in operation, the air flows from the heating roller 34*a* of the fixing device 34 toward the transfer belt 50, as indicated by an arrow B shown in FIG. 1. This causes the temperature of the transfer belt 50 to increase. In other words, the heating roller 34*a* and the exhaust unit 24 function as a temperature increasing unit that increases the temperature of the transfer belt 50. The direction in which the air flows is confirmable by placing dry ice inside the apparatus body 10*a* and checking the direction of flow of white fog produced from the dry ice.

Miscellaneous

As shown in FIG. 8, the image forming apparatus 10 includes a measurement device 80 that measures the time elapsed from when image forming operation for forming an image onto a recording medium P is completed, and also includes a hygrometer 82 that detects a relative humidity within the apparatus body 10*a*.

The "relative humidity within the apparatus body" is a relative humidity in the region in which the transfer belt 50 is disposed inside the apparatus body 10*a*. In detail, the "relative humidity within the apparatus body" is a relative humidity at any location in a region between the peripheral surface of the transfer belt 50 and a position located away from the peripheral surface of the transfer belt 50 by 200 mm, as viewed from the depth direction of the apparatus. In this exemplary embodiment, for example, the hygrometer 82 is disposed below the removing member 36.

Controller 28

As shown in FIG. 8, the controller 28 receives information from the measurement device 80 and the hygrometer 82 and controls the operation of the exhaust fan 72, the fixing device 34, the toner-image forming units 30, and the transfer unit 32. The control of each component by the controller 28 will be described later together with the operation. The controller 28 is an example of an executing unit.

Operation

Next, the operation of the relevant components will be described. In detail, a process in which the controller 28 executes a removal mode by controlling each component to remove a deposit adhered to the transfer belt 50 will be described with reference to a flowchart shown in FIG. 9.

When image forming operation for forming an image onto a recording medium P is completed, the controller 28 stops the operation of the fixing device 34, the transport unit 14, the toner-image forming units 30, and the transfer unit 32. Furthermore, when the image forming operation is completed, the measurement device 80 measures the time elapsed from the completion of the image forming operation.

Figure 9:
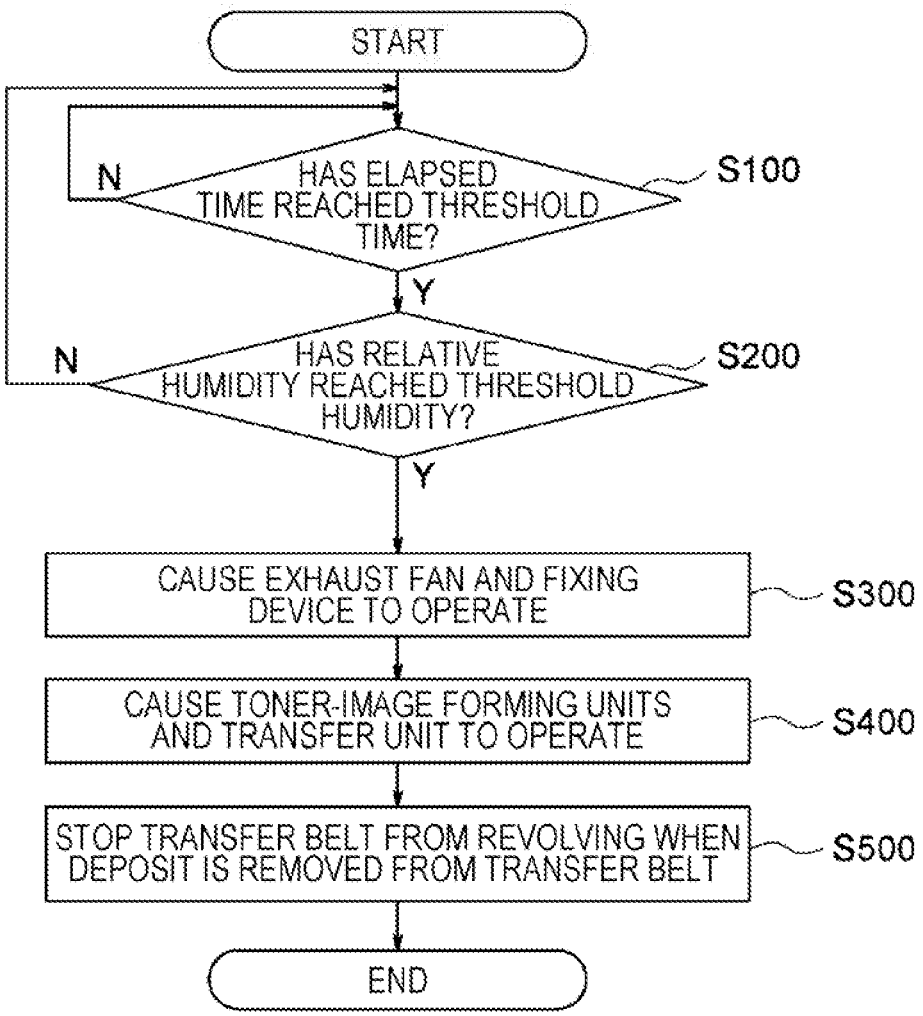
FIG. 9 is a flowchart illustrating the flow when the removal mode is executed in the image forming apparatus according to the first exemplary embodiment of the present disclosure.

In step S100 shown in FIG. 9, the controller 28 determines whether or not the elapsed time measured by the measurement device 80 has passed a threshold time. If the elapsed time has passed the threshold time, the process proceeds to step S200. If the elapsed time has not reached the threshold time, the controller 28 determines again in step S100 whether or not the elapsed time has passed the threshold time. In this exemplary embodiment, the threshold time ranges between 4 hours and 72 hours inclusive, desirably between 5 hours and 10 hours inclusive, and more desirably between 6 hours and 8 hours inclusive in particular. The reason for determining whether or not the elapsed time has reached the threshold time is that, when the elapsed time reaches the threshold time, the adhesive force of a deposit adhered to the transfer belt 50 increases, as compared with a case where the elapsed time has not reached the threshold time.

If the power supply of the image forming apparatus 10 is turned off, the controller 28 determines in step S100 whether or not the elapsed time measured by the measurement device 80 has passed the threshold time from when the power supply is turned on.

In step S200, the controller 28 determines whether or not the relative humidity measured by the hygrometer 82 when the process proceeds to step S200 has reached a threshold humidity. If the relative humidity has reached the threshold humidity, the process proceeds to step S300. If the relative humidity has not reached the threshold humidity, the controller 28 determines again in step S100 whether or not the elapsed time has passed the threshold time. The reason for determining whether or not the relative humidity has reached the threshold humidity is that, when the relative humidity reaches the threshold humidity, the adhesive force of a deposit adhered to the transfer belt 50 increases, as compared with a case where the relative humidity has not reached the threshold humidity.

If the controller 28 determines in step S100 that the elapsed time has reached the threshold time from when the power supply is turned on, the controller 28 determines whether or not the relative humidity when the process proceeds from step S100 to step S200 has reached the threshold humidity.

In step S300, the controller 28 causes the exhaust fan 72 and the fixing device 34 shown in FIG. 1 to operate. With regard to the fixing device 34, the fixing device 34 operates such that the temperature of the peripheral surface of the heating roller 34*a* becomes equal to the temperature thereof during the image forming operation.

The exhaust fan 72 and the fixing device 34 operate in this manner so that the air heated by the heating roller 34*a* flows toward the transfer belt 50 (see the arrow B in FIG. 1), thereby heating the transfer belt 50.

In step S400, the controller 28 causes the black toner-image forming unit 30K and the transfer unit 32 shown in FIG. 1 to operate.

The controller 28 causes the toner-image forming unit 30K to form a cleaning image as an example of a toner image, causes the transfer belt 50 to revolve, and causes the first-transfer roller 52 to transfer the cleaning image onto the transfer belt 50. Furthermore, the controller 28 causes a transfer current to flow to the second-transfer roller 54 such that an electric field opposite to that when a toner image is transferred onto a recording medium P is generated.

In detail, the toner-image forming unit 30K forms a dot image as a cleaning image. Furthermore, the first-transfer roller 52 transfers the dot image as a cleaning image onto the transfer belt 50 over an image formation width in which a toner image is formed in the width direction of the transfer belt 50 and over the circumferential length or more of the transfer belt 50 in the circumferential direction of the transfer belt 50. In other words, the first-transfer roller 52 transfers the dot image as a cleaning image onto the transfer belt 50 such that a part of the transfer belt 50 onto which the cleaning image is transferred first and a part of the transfer belt 50 onto which the cleaning image is transferred last are aligned with each other in the circumferential direction of the transfer belt 50. The "image formation width" is the maximum width in which an image is formable. The "dot image" is an image constituted of evenly distributed dots.

The first-transfer roller 52 transfers the cleaning image onto the transfer belt 50 such that the image density gradually decreases from the part of the cleaning image to be transferred first onto the transfer belt 50 to the part of the cleaning image to be transferred last onto the transfer belt 50. In other words, the first-transfer roller 52 transfers the cleaning image onto the transfer belt 50 such that the image density gradually decreases from the part of the cleaning image to be scraped off and removed first from the transfer belt 50 by the scraping blade 36*a* to the part of the cleaning image to be scraped off and removed last. In this exemplary embodiment, the image density varies from, for example, 100% to 60%. The image density of the dot image as a cleaning image is measurable by using a spectral densitometer (X-Rite 939 manufactured by X-Rite Inc.). Alternatively, the mass of toner per unit area of the transfer belt 50 may be measured, and the image density may be calculated from this mass. In this exemplary embodiment, a dot image having an image density of 100% is a solid image.

Figure 6A:
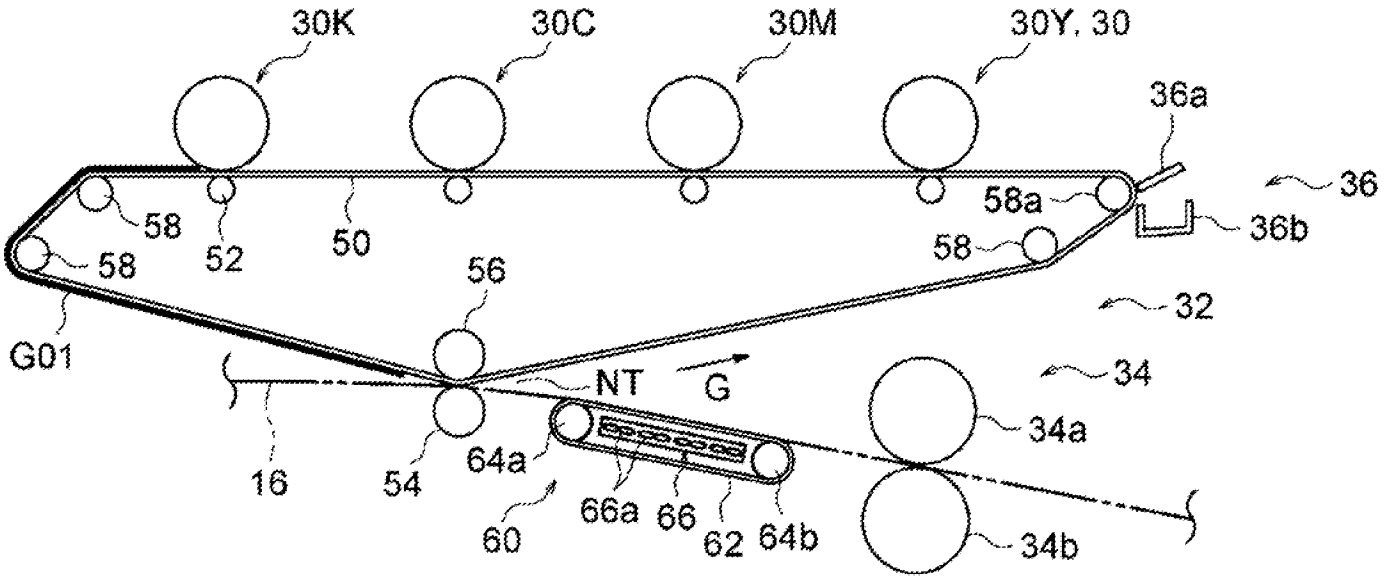
FIGS. 6A and 6B illustrate a process when a removal mode is executed in the image forming apparatus according to the first exemplary embodiment of the present disclosure.
Figure 6B:
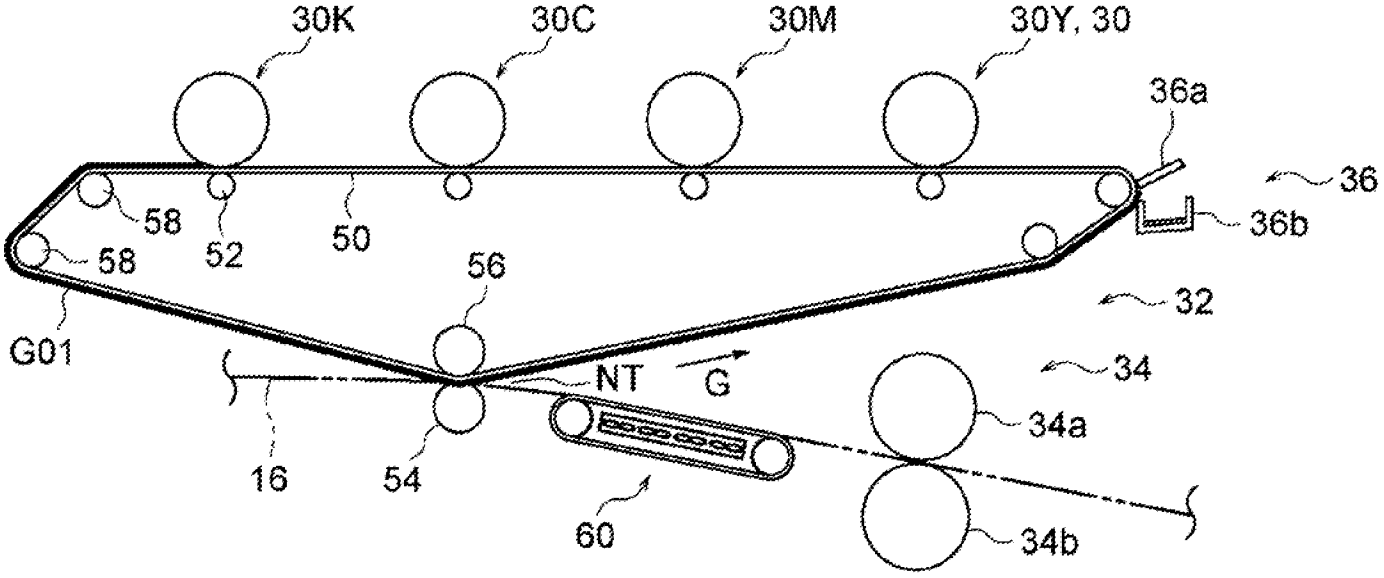

Referring to FIGS. 6A and 6B, the toner-image forming unit 30K and the transfer unit 32 operate in this manner so that a cleaning image (denoted by G01 in FIGS. 6A and 6B) transferred on the heated transfer belt 50 is transported by the revolving transfer belt 50.

Figure 7A:
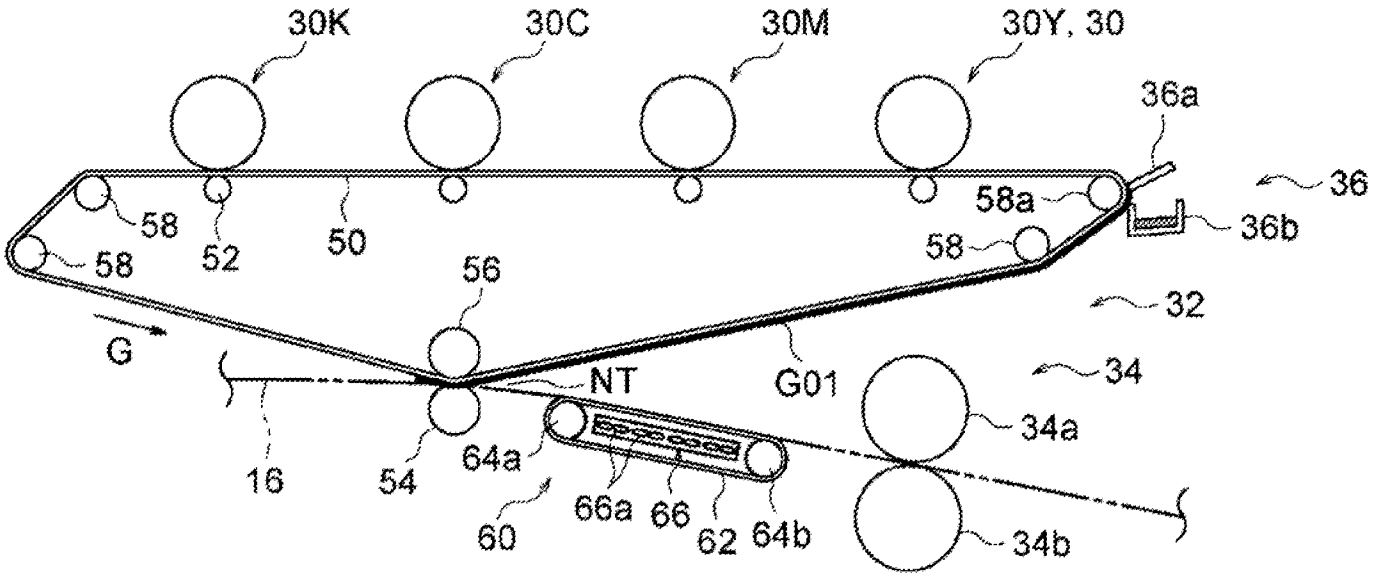
FIGS. 7A and 7B illustrate a process when the removal mode is executed in the image forming apparatus according to the first exemplary embodiment of the present disclosure.
Figure 7B:
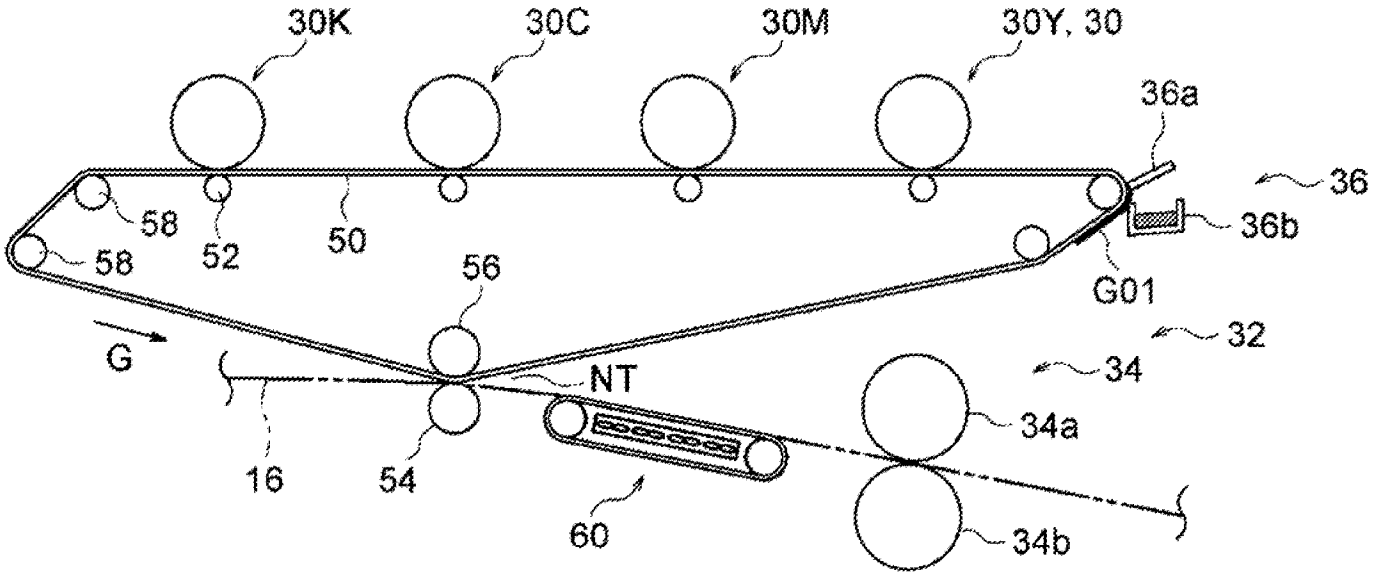

In step S500, when the cleaning image G01 transferred on the transfer belt 50 is removed by the removing member 36, as shown in FIGS. 7A and 7B, the revolving transfer belt 50 stops revolving.

In detail, the cleaning image G01 transported by the revolving transfer belt 50 passes through the second-transfer section NT and reaches the removing member 36. The scraping blade 36*a* of the removing member 36 scrapes off the cleaning image G01 transported by the transfer belt 50 from the transfer belt 50. The collection box 36*b* collects the toner constituting the cleaning image G01 scraped off from the transfer belt 50.

As shown in FIG. 2, the scraping blade 36*a* scrapes off the cleaning image G01 from the transfer belt 50 so that a toner accumulation T01 occurs in the area where the edge of the scraping blade 36*a* and the transfer belt 50 are in contact with each other.

The toner constituting this toner accumulation T01 acts as an abrasive, so that the deposit adhered to the peripheral surface of the transfer belt 50 is scraped off and removed from the transfer belt 50.

The toner constituting the toner accumulation T01 falls into the collection box 36*b* and is collected therein as time passes, but the toner of the cleaning image G01 scraped off from the transfer belt 50 by the scraping blade 36*a* is added as new toner to the toner accumulation T01. Accordingly, the toner accumulation T01 acting as an abrasive is maintained.

As mentioned above, the image density gradually decreases from the part of the cleaning image to be scraped off first from the transfer belt 50 by the scraping blade 36*a* to the part of the cleaning image to be scraped off last. In other words, the amount of toner to be scraped off from the transfer belt 50 by the scraping blade 36*a* gradually decreases from the part of the cleaning image to be scraped off first from the transfer belt 50 to the part of the cleaning image to be scraped off last from the transfer belt 50. Therefore, the toner accumulation T01 occurs faster than a case where the amount of toner to be scraped off first from the transfer belt 50 by the scraping blade 36*a* is equal to the amount of toner to be scraped off and removed last.

Then, when the scraping blade 36*a* scrapes off the entire cleaning image G01 transferred on the transfer belt 50, the controller 28 stops the operation of each component and ends the sequential operation.

Conclusion

As described above, in the image forming apparatus 10, when the controller 28 executes the removal mode for removing a deposit from the transfer belt 50, the controller 28 causes the exhaust fan 72 and the fixing device 34 to operate, so that the air heated by the heating roller 34*a* flows toward the transfer belt 50. Consequently, the transfer belt 50 is heated. With the transfer belt 50 heated, the adhesive force of the deposit adhered to the transfer belt 50 decreases, as compared with a case where the transfer belt 50 is not heated. Therefore, the deposit remaining on the transfer belt 50 may decrease, as compared with a case where the deposit is removed from the transfer belt 50 by the removing member 36 alone.

Furthermore, in the image forming apparatus 10, the deposit remaining on the transfer belt 50 may decrease, as compared with a case where the deposit is removed from the transfer belt 50 by the removing member 36 alone, so that the transfer performance for transferring a toner image from the transfer belt 50 onto a recording medium P may improve. In particular, in a case where the recording medium P used is textured paper, such as embossed paper, having a textured surface, the transfer performance for the toner image to be transferred onto the recording medium P from the transfer belt 50 may improve. In this case, "textured paper" is paper having a textured pattern, and the difference in height of the textured section ranges between, for example, 0.05 mm and 1 mm inclusive. Furthermore, in the image forming apparatus 10, when the controller 28 determines that the elapsed time from when the image forming operation is completed has reached the threshold time and that the relative humidity within the apparatus body 10*a* is higher than or equal to the threshold humidity, the controller 28 executes the removal mode. By executing the removal mode when the adhesive force of the deposit on the transfer belt 50 increases, the number of times the removal mode is executed may be reduced while the deposit is removed from the transfer belt 50, as compared with a case where the removal mode is executed regardless of the elapsed time from when the image forming operation is completed and the relative humidity within the apparatus body 10*a*. In this case, "when the image forming operation is completed" corresponds to when a toner image is fixed onto the last recording medium P.

Furthermore, in the image forming apparatus 10, the toner accumulation T01 with a predetermined size may occur faster than in a case where the amount of toner to be scraped off first from the transfer belt 50 by the scraping blade 36*a* is smaller than the amount of toner to be scraped off last. In other words, an abrasive may occur faster than in a case where the amount of toner to be scraped off first from the transfer belt 50 by the scraping blade 36*a* is smaller than the amount of toner to be scraped off last, so that the deposit remaining on the transfer belt 50 may decrease.

Furthermore, in the image forming apparatus 10, the image density gradually decreases from the part of the cleaning image to be removed first from the transfer belt 50 by the removing member 36 to the part of the cleaning image to be removed last. Therefore, the toner accumulation T01 having a predetermined size may be maintained, as compared with a case where the cleaning image is constituted only of a part of a dot image with an image density to be removed first from the transfer belt 50 and a part of the dot image with an image density to be removed last from the transfer belt 50, whereby the deposit remaining on the transfer belt 50 may decrease.

Second Exemplary Embodiment

Next, an example of an image forming apparatus according to a second exemplary embodiment of the present disclosure will be described with reference to FIGS. 12 and 13. The second exemplary embodiment will be described while focusing on features different from those of the first exemplary embodiment.

Configuration

Figure 12:
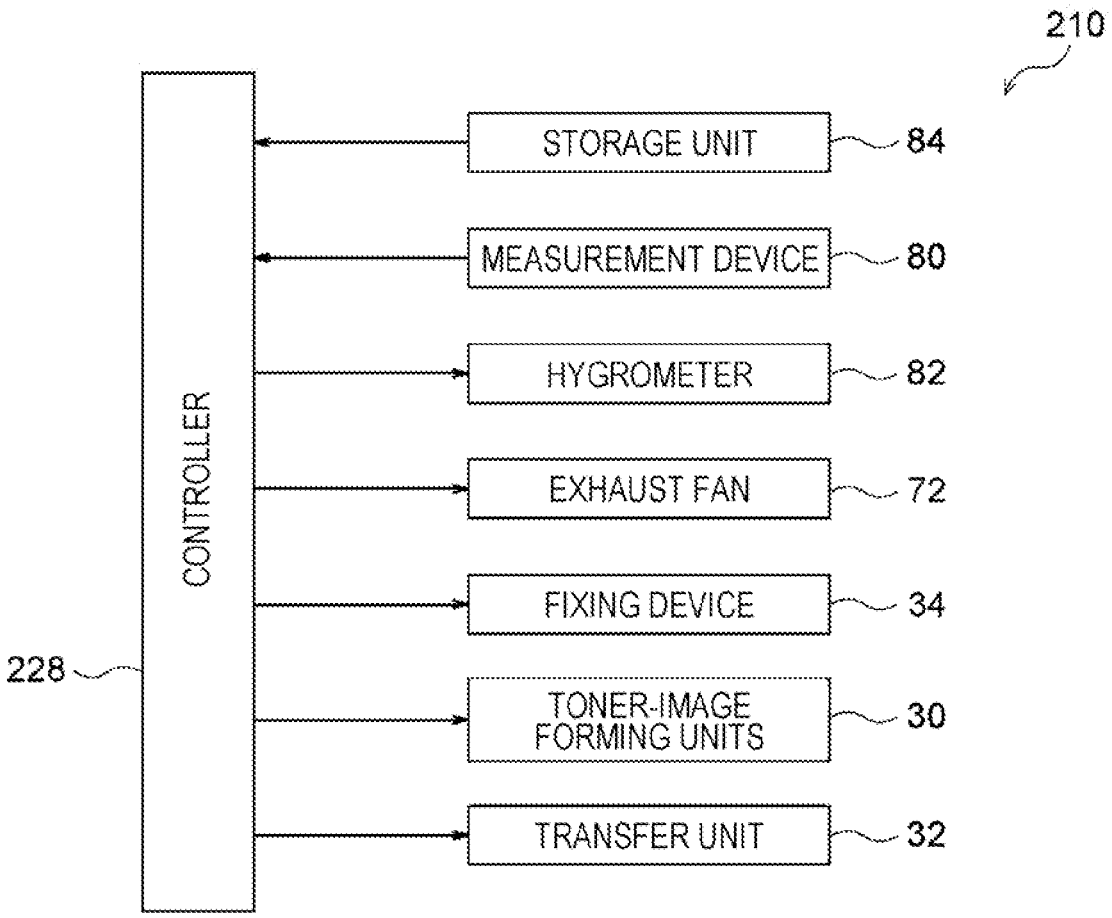
FIG. 12 is a block diagram illustrating a control system of a controller included in an image forming apparatus according to a second exemplary embodiment of the present disclosure.
Figure 13:
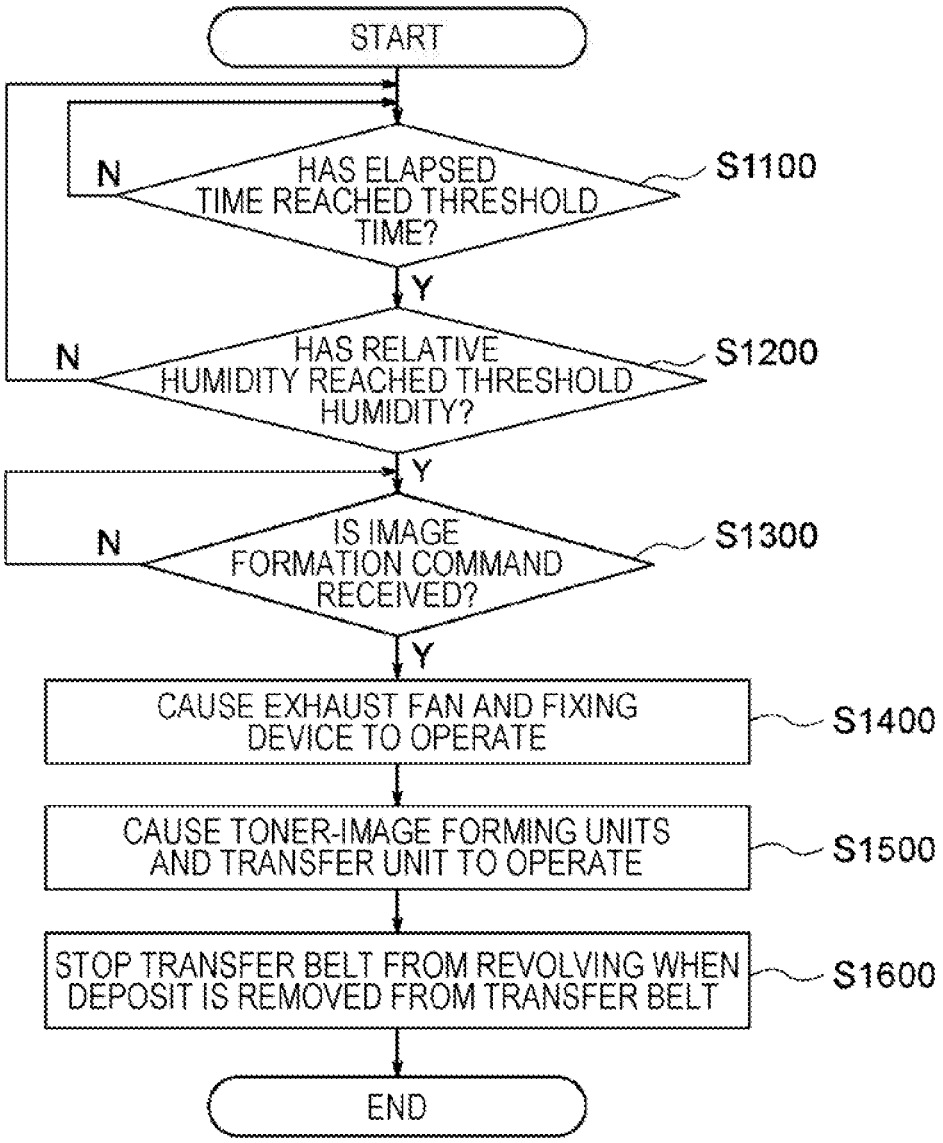
FIG. 13 is a flowchart illustrating the flow when the removal mode is executed in the image forming apparatus according to the second exemplary embodiment of the present disclosure.

As shown in FIG. 12, an image forming apparatus 210 according to the second exemplary embodiment has a storage unit 84 that stores, for example, the sheet type of recording media P accommodated in the accommodation member 20 (see FIG. 11).

A controller 228 of the image forming apparatus 210 receives information from the storage unit 84, the measurement device 80, and the hygrometer 82, and controls the operation of the exhaust fan 72, the fixing device 34, the toner-image forming units 30, and the transfer unit 32. The control of each component by the controller 228 will be described later together with the operation. The controller 228 is an example of an executing unit.

Operation

Next, a process in which the controller 228 executes the removal mode by controlling each component to remove a deposit adhered to the transfer belt 50 will be described with reference to a flowchart shown in FIG. 13.

When image forming operation is completed, the measurement device 80 measures the time elapsed from the completion of the image forming operation. Then, in step S1100 shown in FIG. 13, the controller 228 determines whether or not the elapsed time measured by the measurement device 80 has reached a threshold time. If the elapsed time has reached the threshold time, the process proceeds to step S1200. If the elapsed time has not reached the threshold time, the controller 228 determines again in step S1100 whether or not the elapsed time has passed the threshold time.

In step S1200, the controller 228 determines whether or not the relative humidity measured by the hygrometer 82 when the process proceeds to step S1200 has reached a threshold humidity. If the relative humidity has reached the threshold humidity, the process proceeds to step S1300. If the relative humidity has not reached the threshold humidity, the controller 228 determines again in step S1100 whether or not the elapsed time has passed the threshold time.

In step S1300, the controller 228 determines whether or not an image formation command (i.e., a print job) for forming a toner image onto a recording medium P as textured paper having a textured surface is received. In detail, the controller 228 determines whether or not the recording medium P designated by the image formation command is textured paper in accordance with information stored in the storage unit 84.

If the image formation command for forming the toner image onto the recording medium P as textured paper is received, the process proceeds to step S1400. If the image formation command for forming the toner image onto the recording medium P as textured paper is not received, the controller 228 determines again in step S1300 whether or not the image formation command is received.

In step S1400, the controller 228 causes the exhaust fan 72 and the fixing device 34 shown in FIG. 1 to operate. With regard to the fixing device 34, the fixing device 34 operates such that the temperature of the peripheral surface of the heating roller 34*a* becomes equal to the temperature thereof during the image forming operation.

In step S1500, the controller 228 causes the toner-image forming unit 30K and the transfer unit 32 shown in FIG. 1 to operate.

The controller 228 causes the toner-image forming unit 30K to form a cleaning image as an example of a toner image, causes the transfer belt 50 to revolve, and causes the first-transfer roller 52 to transfer the formed cleaning image onto the transfer belt 50. Furthermore, the controller 228 causes a transfer current to flow to the second-transfer roller 54 such that an electric field opposite to that when a toner image is transferred onto a recording medium P is generated.

In step S1600, when the cleaning image G01 transferred on the transfer belt 50 is removed by the removing member 36, as shown in FIGS. 7A and 7B, the revolving transfer belt 50 stops revolving. Then, the controller 228 stops the operation of each component and ends the sequential operation.

Conclusion

As described above, in the image forming apparatus 210, when the controller 228 receives an image formation command for forming a toner image onto a recording medium P as textured paper, the controller 228 executes the removal mode before image forming operation is executed. Therefore, the number of times the removal mode is executed may be reduced while the transfer performance for the toner image to be transferred onto the textured paper from the transfer belt 50 may be maintained, as compared with a case where the removal mode is executed even when the image formation command for forming the toner image onto the recording medium P is not received.

Although specific exemplary embodiments of the present disclosure have been described in detail, the present disclosure is not limited to the above exemplary embodiments. It is obvious to a skilled person that various exemplary embodiments are possible within the scope of the disclosure. For example, in each of the above exemplary embodiments, the removal mode is executed when a predetermined condition is satisfied. Alternatively, for example, a command switch for commanding execution of the removal mode may be provided, such that the removal mode may be executed when the user turns on the command switch.

In the above exemplary embodiments, one of the conditions for executing the removal mode is a condition in which the relative humidity within the apparatus body 10*a* becomes higher than or equal to the threshold humidity. Alternatively, the removal mode may be executed regardless of the relative humidity within the apparatus body 10*a*. In this case, however, the advantage achieved by setting the relative humidity as one of the conditions for executing the removal mode is not exhibited.

Furthermore, in the above exemplary embodiments, the removing member 36 equipped with the scraping blade 36*a* is described as an example of a removing member that removes a deposit from the transfer belt 50. An alternative example is a removing member equipped with a removing brush.

The above exemplary embodiments have been described with reference to the image forming apparatus 10 of a tandem type. Alternatively, an image forming apparatus of a rotary type may be used so long as the image forming apparatus is equipped with a transfer belt or a transfer drum.

Furthermore, in the second exemplary embodiment, the removal mode is executed when an image formation command for forming a toner image onto a recording medium P as textured paper having a textured surface is received. Alternatively, the removal mode may be executed when an image formation command for forming a toner image onto a recording medium P is received regardless of the sheet type thereof.

Consequently, the number of times the removal mode is executed may be reduced while the transfer performance for the toner image to be transferred onto the recording medium P from the transfer belt 50 may be maintained, as compared with a case where the removal mode is executed even when the image formation command is not received. In this case, however, the advantage achieved when the recording medium P designated for forming a toner image thereon is textured paper having a textured surface is not exhibited.

Although not specified in the above exemplary embodiments, the suction fan 66*a* of the belt unit 60 may operate during the removal mode. By causing the suction fan 66*a* to operate, the heat of the heating roller 34*a* may be prevented from traveling away from the transfer belt 50 (see the arrow A in FIG. 1).

Furthermore, in the above exemplary embodiments, a cleaning image is formed by using the toner-image forming unit 30K. Alternatively, a cleaning image may be formed by using a toner-image forming unit 30 for another color, or cleaning images may be formed by using multiple toner-image forming units.

Furthermore, in the above exemplary embodiments, the first-transfer roller 52 transfers the cleaning image onto the transfer belt 50 such that the image density gradually decreases from the part of the cleaning image to be transferred first onto the transfer belt 50 to the part of the cleaning image to be transferred last onto the transfer belt 50. Alternatively, the cleaning image may be another image so long as the image is continuous in the revolving direction of the transfer belt 50.

Furthermore, in the above exemplary embodiments, the first-transfer roller 52 transfers the cleaning image onto the transfer belt 50 such that the image density gradually decreases from the part of the cleaning image to be transferred first onto the transfer belt 50 to the part of the cleaning image to be transferred last onto the transfer belt 50. Alternatively, the first-transfer roller 52 may transfer the cleaning image onto the transfer belt 50 such that the image density decreases in a stepwise fashion.

Furthermore, in the above exemplary embodiments, the dot image is formed as a cleaning image by the toner-image forming unit 30K. Alternatively, the dot image may be formed as a cleaning image by using a toner-image forming unit 30 for another color.

Furthermore, in the second exemplary embodiment, the revolving transfer belt 50 stops revolving in step S1600. Alternatively, the print job received in step S1300 may be executed without stopping the transfer belt 50 from revolving.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a transfer belt that revolves;

a first-transfer roller that transfers a toner image onto the transfer belt;

a second-transfer roller that transfers the toner image on the transfer belt onto a recording medium;

a cleaning blade that is disposed downstream of the second-transfer roller and upstream of the first-transfer roller in a revolving direction of the transfer belt and that removes a deposit adhered on the transfer belt;

a fixing device that generates heat and that fixes the toner image transferred on the recording medium by the second-transfer roller onto the recording medium;

a fan configured to cause air to flow from the fixing device toward the transfer belt; and a controller that executes a removal mode including causing the fixing device to generate heat, causing the fan to operate, causing the transfer belt to operate, causing the first-transfer roller to operate so as to transfer a cleaning image as a toner image onto the transfer belt, and causing the cleaning blade to remove the cleaning image from the transfer belt without causing the second-transfer roller to transfer the cleaning image onto the recording medium.

2. The image forming apparatus according to claim 1, wherein, in a case where a threshold time elapses from when image forming operation for forming an image onto the recording medium is completed and a relative humidity within an apparatus body becomes higher than or equal to a threshold humidity, the controller executes the removal mode.

3. The image forming apparatus according to claim 2, wherein the first-transfer roller transfers a dot image as the cleaning image onto the transfer belt over an image formation width in which the toner image is formed in a width direction of the transfer belt and over a circumferential length or more of the transfer belt in a circumferential direction of the transfer belt, such that an image density of a part of the cleaning image to be removed first from the transfer belt by the cleaning blade is higher than an image density of a part of the cleaning image to be removed last from the transfer belt by the cleaning blade.

4. The image forming apparatus according to claim 3, wherein the first-transfer roller transfers the cleaning image onto the transfer belt such that the image density gradually decreases from the part of the cleaning image to be removed first from the transfer belt by the cleaning blade to the part of the cleaning image to be removed last.

5. The image forming apparatus according to claim 1, wherein, in a case where a threshold time elapses from when image forming operation for forming an image onto the recording medium is completed, a relative humidity within an apparatus body becomes higher than or equal to a threshold humidity, and an image formation command for forming an image onto a recording medium is received, the controller executes the removal mode before executing the image forming operation.

6. The image forming apparatus according to claim 5, wherein, in a case where the recording medium designated for forming a toner image thereon in accordance with the image formation command is textured paper having a textured surface, the controller executes the removal mode.

7. The image forming apparatus according to claim 6, wherein the first-transfer roller transfers a dot image as the cleaning image onto the transfer belt over an image formation width in which the toner image is formed in a width direction of the transfer belt and over a circumferential length or more of the transfer belt in a circumferential direction of the transfer belt, such that an image density of a part of the cleaning image to be removed first from the transfer belt by the cleaning blade is higher than an image density of a part of the cleaning image to be removed last from the transfer belt by the cleaning blade.

8. The image forming apparatus according to claim 7, wherein the first-transfer roller transfers the cleaning image onto the transfer belt such that the image density gradually decreases from the part of the cleaning image to be removed first from the transfer belt by the cleaning blade to the part of the cleaning image to be removed last.

9. The image forming apparatus according to claim 5, wherein the first-transfer roller transfers a dot image as the cleaning image onto the transfer belt over an image formation width in which the toner image is formed in a width direction of the transfer belt and over a circumferential length or more of the transfer belt in a circumferential direction of the transfer belt, such that an image density of a part of the cleaning image to be removed first from the transfer belt by the cleaning blade is higher than an image density of a part of the cleaning image to be removed last from the transfer belt by the cleaning blade.

10. The image forming apparatus according to claim 9, wherein the first-transfer roller transfers the cleaning image onto the transfer belt such that the image density gradually decreases from the part of the cleaning image to be removed first from the transfer belt by the cleaning blade to the part of the cleaning image to be removed last.

11. The image forming apparatus according to claim 1, wherein the first-transfer roller transfers a dot image as the cleaning image onto the transfer belt over an image formation width in which the toner image is formed in a width direction of the transfer belt and over a circumferential length or more of the transfer belt in a circumferential direction of the transfer belt, such that an image density of a part of the cleaning image to be removed first from the transfer belt by the cleaning blade is higher than an image density of a part of the cleaning image to be removed last from the transfer belt by the cleaning blade.

12. The image forming apparatus according to claim 11, wherein the first-transfer roller transfers the cleaning image onto the transfer belt such that the image density gradually decreases from the part of the cleaning image to be removed first from the transfer belt by the cleaning blade to the part of the cleaning image to be removed last.

13. An image forming apparatus comprising:

revolving means;

first-transfer means for transferring a toner image onto the revolving means;

second-transfer means for transferring the toner image on the revolving means onto a recording medium;

removing means for removing a deposit adhered on the revolving means, the removing means being disposed downstream of the second-transfer means and upstream of the first-transfer means in a revolving direction of the revolving means;

fixing means for generating heat and for fixing the toner image transferred on the recording medium by the second-transfer means onto the recording medium;

generating means for causing air to flow from the fixing means toward the revolving means; and executing means for executing a removal mode including causing the fixing means to generate heat, causing the generating means to operate, causing the revolving means to operate, causing the first-transfer means to operate so as to transfer a cleaning image as a toner image onto the revolving means, and causing the removing means to remove the cleaning image from the revolving means without causing the second-transfer means to transfer the cleaning image onto the recording medium.

* * * * *